United States Patent [19]

Cumming et al.

[11] 4,213,167

[45] Jul. 15, 1980

[54] PLANAR GAS AND ION DISTRIBUTION

[76] Inventors: James M. Cumming, 4571 Comber Ave., Encino, Calif. 91316; Donald G. Saurenman, 6787 Worsham Dr., Whittier, Calif. 90602

[21] Appl. No.: 892,140

[22] Filed: Mar. 31, 1978

[51] Int. Cl.[2] ..... H05F 3/00

[52] U.S. Cl. ..... 361/213; 361/230; 15/1.5 R

[58] Field of Search ..... 361/213, 214, 220, 229, 361/230; 15/306 R, 306 A, 306 B, 310, 316 R, 1.5 R

[56] References Cited

U.S. PATENT DOCUMENTS

| | | | |
|---|---|---|---|
| 1,731,030 | 10/1929 | Thompson | 361/213 |
| 3,128,492 | 4/1964 | Hanscom et al. | 15/1.5 R |
| 3,156,847 | 11/1964 | Schweriner | 361/230 |
| 3,308,343 | 3/1967 | Smith et al. | 361/213 |
| 3,475,652 | 10/1969 | Levy | 361/213 |
| 3,619,719 | 11/1971 | Waller et al. | 361/230 |
| 3,643,128 | 2/1972 | Testone | 361/230 |
| 3,644,953 | 2/1972 | Christiansen | 15/1.5 R |
| 4,048,667 | 9/1977 | Brennecke | 361/213 |

*Primary Examiner*—J. D. Miller
*Assistant Examiner*—L. C. Schroeder
*Attorney, Agent, or Firm*—William W. Haefliger

[57] ABSTRACT

A film strip, as for example photograph film, is treated to remove static and dust thereon by directing gaseous streams across opposite film surfaces, and by distributing ions into the gas streams to be carried into contact with the film opposite surfaces, for neutralizing the static and enabling dust to be blown off such surfaces.

1 Claim, 3 Drawing Figures

PLANAR GAS AND ION DISTRIBUTION

BACKGROUND OF THE INVENTION

This invention relates generally to treatment of film such as photographic film, and more particularly concerns removal of dust from film strip surfaces as well as elimination of static on said surfaces.

Printing speeds have been enormously increased during the last few years. This is particularly true of printing photographic images on photographic paper. The older printers require that a negative be manually placed in a printing "gate". This older method is rapidly being displaced in the printing of amateur films. For example, the strips of customer film can now be spliced into long rolls and then printed automatically on machines that are operated by computers. Speeds have correspondingly increased from a few dozen prints to thousands of prints per hour, made automatically.

Further, the use of small negative film formats like the 35 MM and even 110 has increased manyfold, and laboratories are now making large blowups from very small negatives. However, the increased printing speed greatly enhances the amount of static generated on the film and therefore the amount of dust that is attracted to the film surface. Such dust particles are particularly troublesome on small negatives being used to produce large size prints. Static generated on the film tends to hold the dust or to reattract the dust whenever it is physically wiped off. This has resulted in the need for much reprinting in high speed production laboratories. It has been found that film can be cleaned by blowing a jet of compressed air across the film. In some cases this air has been exposed to a nuclear pellet to cause ionization of the air. When the air around the negative film is ionized, the static bleeds off into the surrounding atmosphere and makes the dust easier to remove. However, this is a passive system depending on the static to bleed off into the air, which is less than satisfactory. Furthermore, the nuclear pellets decay to half their strength every 138.4 days and therefore by the end of the year, when they are picked up for replacement, their effectiveness is but a fraction of their original strength.

SUMMARY OF THE INVENTION

It is a major object of the invention to overcome the above problems and disadvantages through the provision of method and apparatus which will positively remove static and dust from photographic film strips, in a quick, efficient manner, and without need for nuclear pellets.

Basically, the method concerns treatment of film on which static exists, and includes the steps:

(a) directing multiple streams of gas across stationary, predetermined zones directly adjacent opposite film surfaces, and (b) continuously distributing ions into said gaseous streams to be carried into contact with said film surfaces, for neutralizing such static.

It is found that the above method literally blasts the static charge off film or other surfaces with ionized air having a charge opposite from that requiring neutralization. Furthermore, since the ionization strength depends only on the voltage of house current available, there is no deterioration with time. Also, the gas such as air is concentrated in essentially a knife-like or planar pattern, for best results, i.e. blowing off dust released by neutralization.

Further favorable results are obtained by periodically changing the polarity of the ions being distributed by the gaseous, knife-like streams, the polarity change for example being effected at an alternation frequency of 60 cycles per second. Also, the optimum voltage application and the ions are typically generated at the tips of a row of needles, the peak voltage applied to the needles being between 3,500 and 5,500, for safety and good results, although much higher voltages may be employed if safety precautions are taken. The needles typically project through tiny orifices in a body and are arrayed in a row along the bottom of an elongated narrow recess in a carrier body, the structure being such as to minimize the chance of shocking the hand of an operator, despite needle end exposure. The invention represents substantial improvements over apparatus described in U.S. Pat. No. 3,308,344.

These and other objects and advantages of the invention, as well as the details of illustrative embodiments, will be more fully understood from the following description and drawings, in which:

DRAWING DESCRIPTION

DETAILED DESCRIPTION

Figure 1:
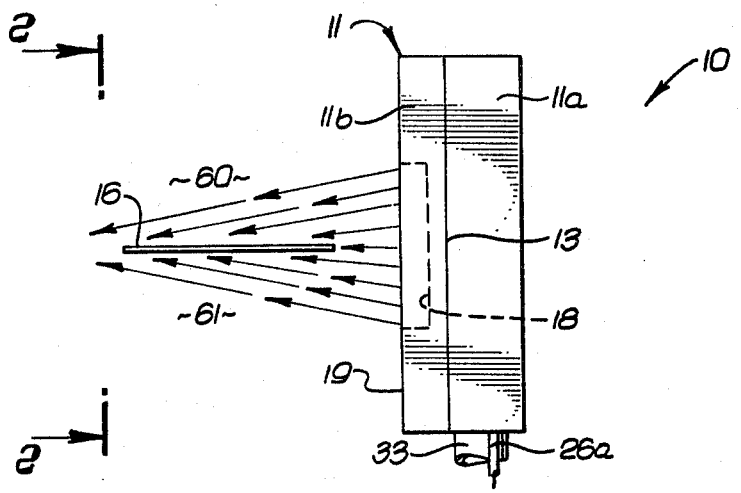
FIG. 1 is a side elevational view of apparatus for treating a strip of photographic film, during processing thereof.

The apparatus 10 shown in the drawings includes a carrier body 11 which may advantageously comprise a rear section 11*a* and a front section 11*b* joined together as by a fastener or fasteners 12, or by a bonding agent at parting plane 13. The two sections preferably consist of insulative material such as a suitable plastic.

Figure 2:
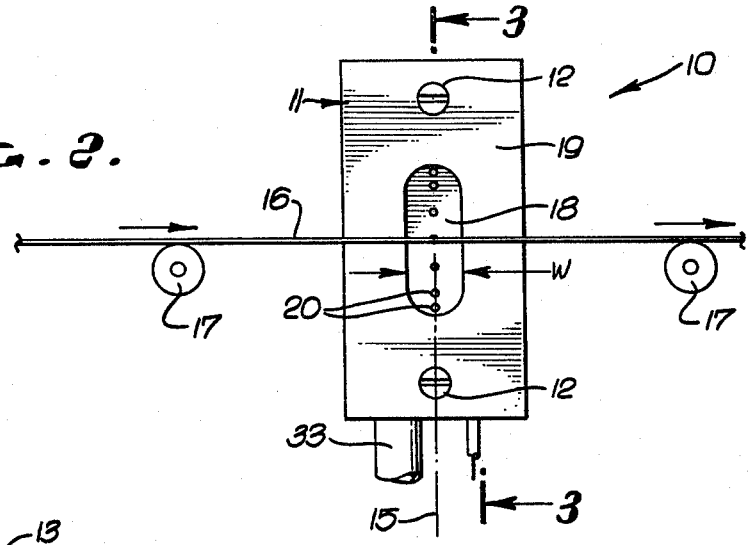
FIG. 2 is a frontal elevation of the FIG. 1 apparatus, taken on lines 2—2 of FIG. 1.
Figure 3:
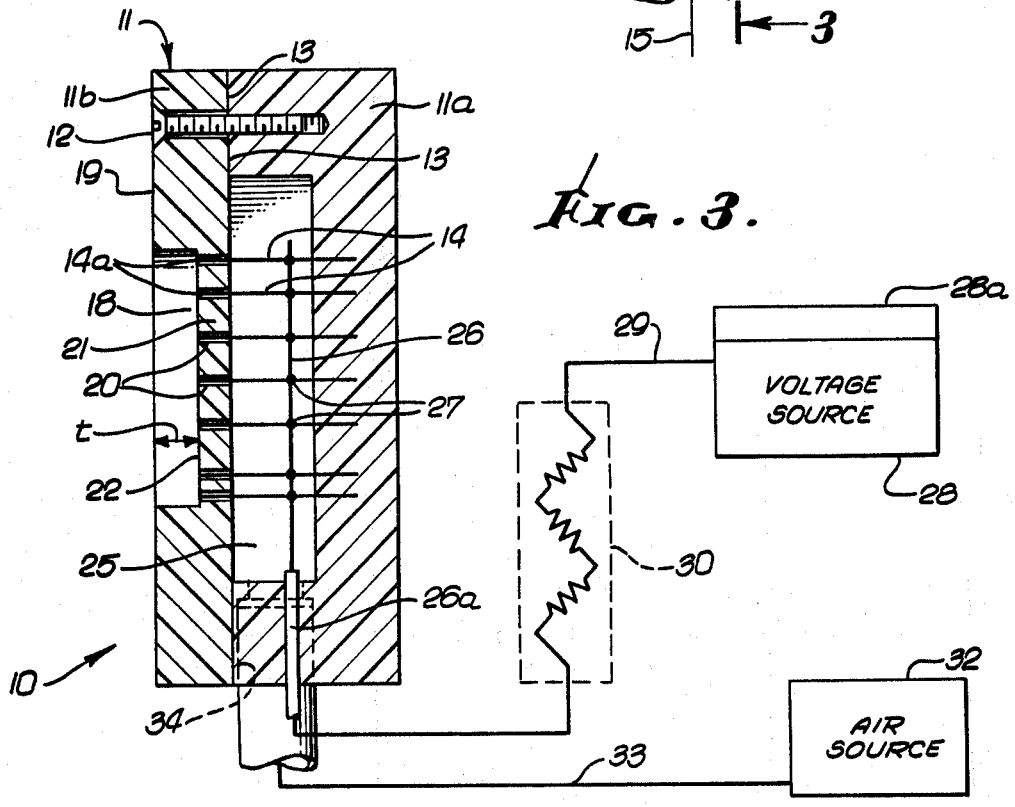
FIG. 3 is an enlarged section on lines 3—3 of FIG. 2.

A row of needles 14 is carried by the body, the needles typically extending in a vertical row as shown, and defining a vertical plane 15 which is perpendicular to the sheet in FIG. 2. A photographic film strip 16 is shown being transported to the right in FIG. 2, perpendicular to and through plane 15. One means to support the film strip is shown to comprise rollers 17, although other supports or holders for the transported film may be used, and associated with apparatus 10.

The tips 14*a* of the needles are exposed within a vertically elongated recess 18 sunk in body section 11*b*, the recess depth "t" from front face 19 being less than the thickness of section 11*b*. The recess width "w" is preferably sufficiently narrow that a user's finger placed against the front face 19 and over the recess does not protrude into the recess far enough to contact any of the neeldes. This safety feature reduces electrical shocking by the needles, to which high voltage (between 3,500 and 5,500 volts) is normally applied. At the same time, no screen is then needed to cover the recess. Such a screen would interfere with the outward flow of air (or other gas) and ions required to treat, i.e. electrically neutralize, the film 16. The width "w" is less than 10 mm, for best results, and preferably about 7 mm. Depth "t" may be about 2 to 3 mm.

For simplicity, the needles are carried by the other body section 11*a*, and are typically embedded in the plastic material of that section as shown. Structure on the carrier defines a line or row of orifices 20 through which the ends of the needles projects, and typically through thinned wall portion 21 of section 11*b* inwardly of recess 18. Note that the ends of the needles are very close to recess bottom wall 22, i.e. they do not project deeply into recess 18. The diameter of the orifices is typically less than 0.5 mm, and preferably about 0.2 to 0.4 mm.

The needles also project within a cavity 25 sunk in the body section 11*a*, and a length greater than the length of recess 18. Accordingly, the metallic, electrically conductive needles can easily be joined to a bus wire 26, as at locations 27 in the cavity. Wire 26, sheathed at 26*a*, extends through the wall of section 11*a*, and supplied with high voltage from a source 28, via cable 29 and resistor 30, which may be varied, as indicated. It has been observed that the use of resistor array 30 produces voltage spikes which enhance performance.

In addition, means is provided to supply pressurized gas, such as air or nitrogen to cavity 25. A source of such air flow is indicated at 32, connected as via flexible tubing 33 to port 34 in body 11. Such pressurized air in the cavity jets from the orifices 20 in well defined streams which are vertically spaced apart, recess 18 also aiding this shaping of the sharp lateral air flow streams to have an "air knife" effect, thereby to sweep opposite sides of the film strip as is clear from FIG. 1. The high voltage applied to the needles results in the production of ions which are carried by the air streams to sweep against the opposite sides of the film, and also to zones 60 and 61 above and below the film strip, neutralizing static on the film and also sweeping dust off the film surfaces, the amount of air and quantity of ions being such as to achieve this purpose. In this regard, best results are achieved when the peak voltage above zero applied to the needles is between 3,500 and 5,500 volts. The voltage at the output of source 28 may be at a higher level (as for example 12,000 volts) which is then reduced by a resistor or staggered array of resistors 30. The latter may be variable or varied to allow "tuning" of the voltage at the needles, for optimized performance. One usuable voltage source is described in U.S. Pat. No. 3,308,344 although others may be used, including an AC source. The polarity of the voltage may also be changed or alternated between positive and negative as by appropriate circuitry, indicated for example at 28*a*. The polarity change may be at 60 cycles per second, for very good results.

The location of the resistor or resistors should be close to the needles, for best results. Power supply 28*a* may be remote from the body 11 and from the resistors.

As is clear from FIG. 1, if the film plane intersects the mid-portion of recess 18, the down pressure of air jets above the film is balanced by the up-pressure of air jets below the film, whereby the film strip is not substantially deflected, and need not be supported near the zones 60 and 61. For best results, the air of gas pressure supplied to the plenum cavity 25 is above 25 psi.

Positive or negative ions may be produced by the needles, as determined by the selected polarity of the voltage source output.

We claim:

1. In apparatus for treating a strip of photographic film during processing thereof, the film transported in a longitudinal direction, the combination comprising (a) a carrier body, including a first body block section defining a first transversely elongated recess, and a second body block section overlying said recess and defining a second transversely elongated recess parallel to and overlying the first recess, there being a wall separating said two recesses, and closing the first recess, the second recess being laterally open along its entire length, (b) needles entirely supported by said first body section, the needles having tips defining a plane toward and through which the film is adapted to pass, the needles having wire configuration, (c) said wall defining orifices within which the respective needles project, the orifices communicating between said recesses, the orifices spaced lengthwise of said recesses, said tips located at said walls, (d) means for supplying pressurized gas to said orifices via said first recess and at pressure in excess of about 25 psi to produce gas jets which sweep over said tips and treat both sides of the film, said jets directed generally laterally relative to said longitudinal direction of film transport, (e) and means for supplying voltage to said tips via said needles at a level or levels to effect production of ions distributed laterally with the gas jets for neutralizing static on both sides of the film passing through said plane, said means including a bus wire extending in said first recess and electrically connected to said needles.

* * * * *